US007062804B2

(12) United States Patent
Rouse et al.

(10) Patent No.: US 7,062,804 B2
(45) Date of Patent: Jun. 20, 2006

(54) PATIENT MOVEMENT SYSTEM, METHOD, AND APPARATUS

(76) Inventors: Samuel K. Rouse, P.O. Box 1903, Lucedale, MS (US) 39452; Amandia K. Rouse, P. O. Box 1903, Lucedale, MS (US) 39452

( * ) Notice: Subject to any disclaimer, the term of this patent is extended or adjusted under 35 U.S.C. 154(b) by 96 days.

(21) Appl. No.: 10/927,995

(22) Filed: Aug. 27, 2004

(65) Prior Publication Data

US 2005/0044629 A1 Mar. 3, 2005

Related U.S. Application Data

(60) Provisional application No. 60/498,022, filed on Aug. 27, 2003.

(51) Int. Cl.
*A61G 7/14* (2006.01)

(52) U.S. Cl. ..... 5/83.1; 5/87.1; 5/88.1; 5/89.1

(58) Field of Classification Search ..... 5/81.1 R, 5/83.1, 85.1, 87.1, 88.1, 89.1; 212/331, 332, 212/251, 246, 901; 254/385
See application file for complete search history.

(56) References Cited

U.S. PATENT DOCUMENTS 4,627,119 A * 12/1986 Hachey et al. ..... 5/85.1
4,639,955 A * 2/1987 Carminati et al. ..... 5/85.1
5,072,840 A * 12/1991 Asakawa et al. ..... 212/312
5,406,658 A * 4/1995 Olkkonen et al. ..... 5/83.1
5,708,993 A * 1/1998 Campbell et al. ..... 5/86.1
5,758,371 A * 6/1998 VanDyke et al. ..... 5/86.1
6,035,465 A * 3/2000 Rogozinski ..... 5/83.1

* cited by examiner

*Primary Examiner*—Michael Trettel
(74) *Attorney, Agent, or Firm*—Thomas, Kayden, Horstemeyer & Risley, LLP

(57) ABSTRACT

A patient movement system comprises a rotatable section coupled to a frame that moves in a horizontal plane. A hoist assembly is coupled to the rotatable section and spins relative to the rotatable section. The hoist assembly may be positioned by the rotatable section. The hoist assembly includes a first motor coupled to a first linearly moving pulley by a first linkage. The first linkage includes horizontal and vertical sections of travel, whereby the vertical sections of travel decrease when the horizontal sections of travel increase. The hoist assembly includes a second motor coupled to a second linearly moving pulley by a second linkage. The second linkage includes horizontal and vertical sections of travel, whereby the vertical sections of travel are decrease when the horizontal sections of travel increase. The hoist assembly may include additional pulleys to guides the first and second linkages.

17 Claims, 12 Drawing Sheets

PATIENT MOVEMENT SYSTEM, METHOD, AND APPARATUS

CROSS-REFERENCE TO RELATED APPLICATION

This application claims priority to copending U.S. provisional application entitled, "Patient Lift System, Apparatus and Method," filed Aug. 27, 2003 and having Ser. No. 60/498,022, which is entirely incorporated herein by reference.

FIELD

This disclosure generally relates to a patient movement aid for immobilized and other incapacitated individuals who desire to move to and from their beds, wheelchairs, bathtubs, etc. and, more particularly, to a system, method, and apparatus moving a person from one location to another.

BACKGROUND

When an immobilized or incapacitated person attempts to move from one location to another, he or she usually relies on others for assistance. Due to the nature of the person's immobilization, physical movements can be difficult to nearly impossible in some instances. In many situations, coordinating the movements of an immobilized and/or incapacitated person with an assisting person oftentimes is a great inconvenience to the assisting person and a great cost to the immobilized person.

Devices are available to assist immobilized and incapacitated persons to some degree. For example, lifting devices may be used to lift and move an immobilized or incapacitated person from one position or location to another. Many lifting devices are operated by two or more operators in addition to the person being lifted. Often the controls of the lifting device are placed at one location for a first user to operate, such as a nurse, while a second user simultaneously assists the patient to protect against problem or injury. In addition, many current lifts are plagued by nonfluidity of motion, such that the person being lifted can be suddenly dropped, which may actually cause additional injury to that person.

Moreover, other lifts commonly have a single lifting point, which can crumple the patient into an uncomfortable position. Stated another way, such lifts may comprise a single cable with a nonrigid harness that essentially squeezes the patient's arms and legs during lifting. These are but a few of the numerous deficiencies with current patient lifting devices.

A heretofore unaddressed need exists to address the aforementioned deficiencies and inadequacies described above.

BRIEF DESCRIPTION OF THE DRAWINGS

The systems, methods, and apparatus according to this disclosure can be better understood with reference to the following drawings.

DETAILED DESCRIPTION

The present disclosure relates to a patient movement apparatus for lifting persons who may be immobilized or incapacitated in some respect. Patient movement devices may be commonly used with immobilized or incapacitated patients to assist a caregiver in performing a variety of functions. This movement device can be used to transport the patient or other persons from a seated or resting position to another resting position or it can be used to transport the patient to a bathing facility, lavatory, or other locations. This movement device may be used for assisting a caregiver to bathe and clothe a patient, as a nonlimiting example.

For purposes of this disclosure, reference is made to the person being lifted as the patient, but that reference is merely a nonlimiting example. One of ordinary skill in the art would know that the movement device could be implement to lift persons, animals, objects, etc.

This patient movement apparatus of this disclosure allows an operator (such as, in one nonlimiting example, a patient or caregiver) to change the patient's position in numerous ways. The device allows for a sitting position as well as elevation of a person's lower back, hip, or upper legs. As a nonlimiting example, a patient may be lowered into a whirlpool, wheelchair, bed, or other desired location by the patient movement device disclosed herein. Operation of the device can be performed by a caregiver or an individual using his or her own controls.

The patient movement system and apparatus comprise a rotatable section coupled to a frame that moves in a horizontal plane. A hoist assembly is coupled to the rotatable section and spins relative to the rotatable section. The hoist assembly may be positioned by the rotatable section. The hoist assembly includes a first motor coupled to a first linearly moving pulley by a first linkage. The first linkage includes horizontal and vertical sections of travel, whereby the vertical sections of travel decrease when the horizontal sections of travel increase. The hoist assembly includes a second motor coupled to a second linearly moving pulley by a second linkage. The second linkage includes horizontal and vertical sections of travel, whereby the vertical sections of travel decrease when the horizontal sections of travel increase. The hoist assembly may include additional pulleys to guides the first and second linkages.

Figure 1:
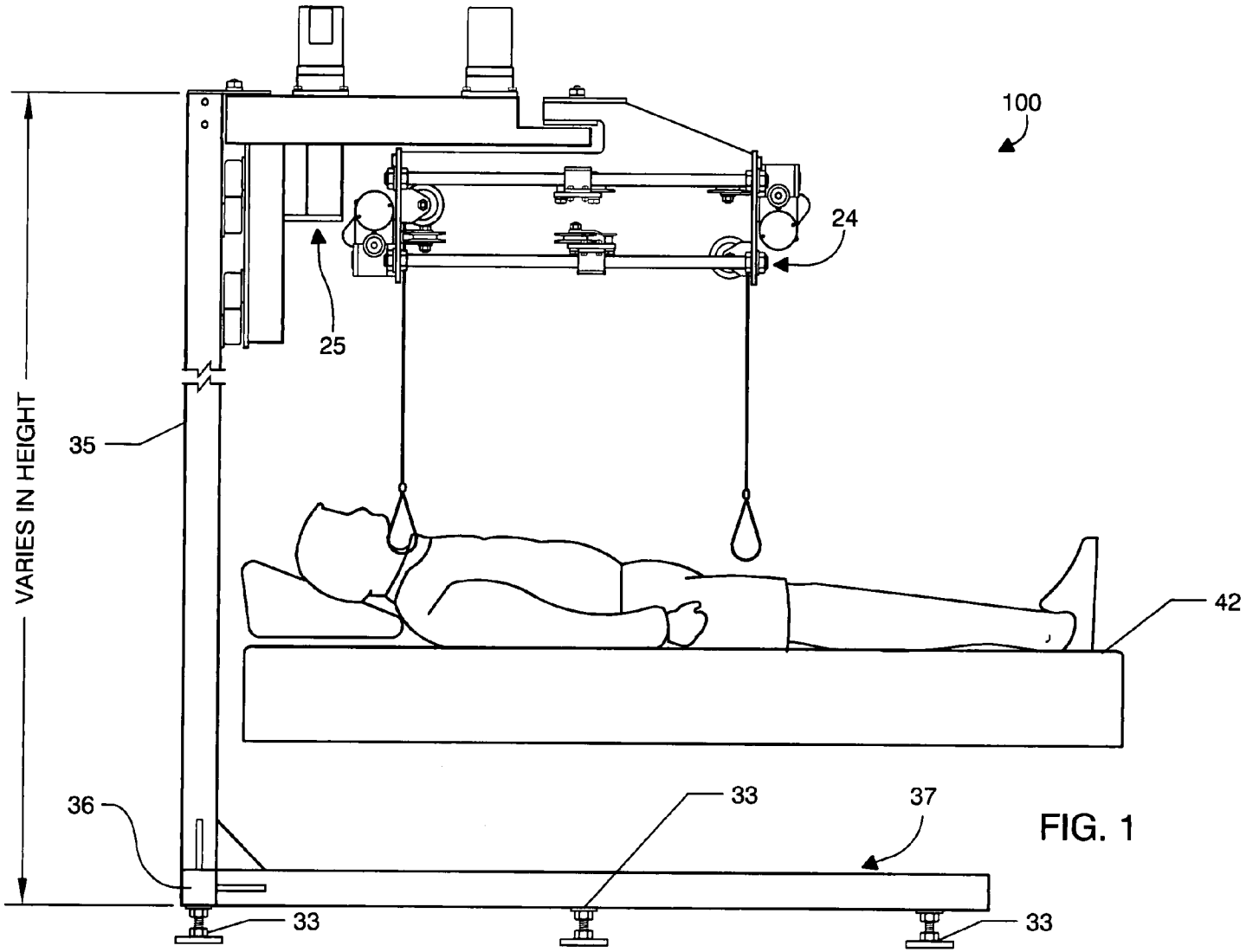
FIG. 1 is an illustration of the patient movement apparatus of the present disclosure.

FIG. 1 is a diagram of the patient movement apparatus 100 with patient (or other person) lying in bed 42. In this nonlimiting example, patient movement apparatus 100 comprises a hoist assembly 24, a rotating arm assembly 25, vertical support 35, and base supports 36 and 37. The total height of the patient movement apparatus 100 may vary depending on allowed ceiling space and individual surface to surface height parameters. One of ordinary skill would know that the cables couple to a body sling (not shown) or other similar device for supporting the person being lifted. Also evident to one with skill in the art, the height and length of the members 34, 35, 36, and 37 may vary depending on different applications. Also, altering adjustable leg units 33 may modify the height of the device.

Figure 2:
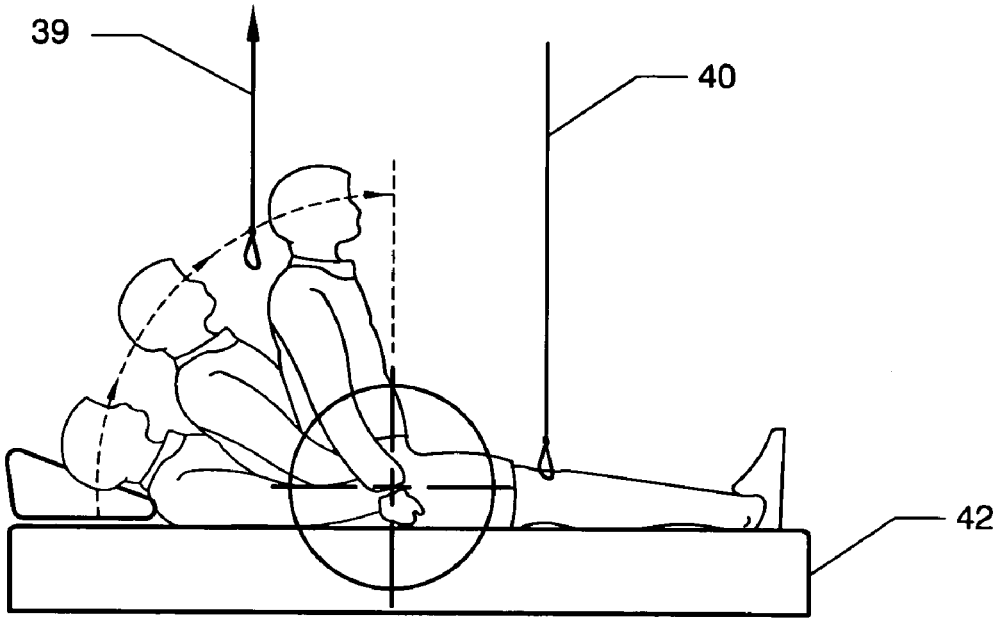
FIG. 2 is an illustration of some of the body positions that may be achieved with use of the patient movement apparatus of FIG. 1.

FIG. 2 is a side view of a patient lying in bed 42. The view in this non-limiting example is shown without patient movement apparatus 100. Operation of the patient movement apparatus 100 allows the head and upper back of a patient to be raised into a sitting position. This figure illustrates but a few of the many positions available to the patient when using the patient movement apparatus 100. As is easily discernible to one with skill in the art, the infinite number of body positions is achieved by cable slings 39 and 40, which are independently adjustable by patient movement apparatus 100.

Figure 3:
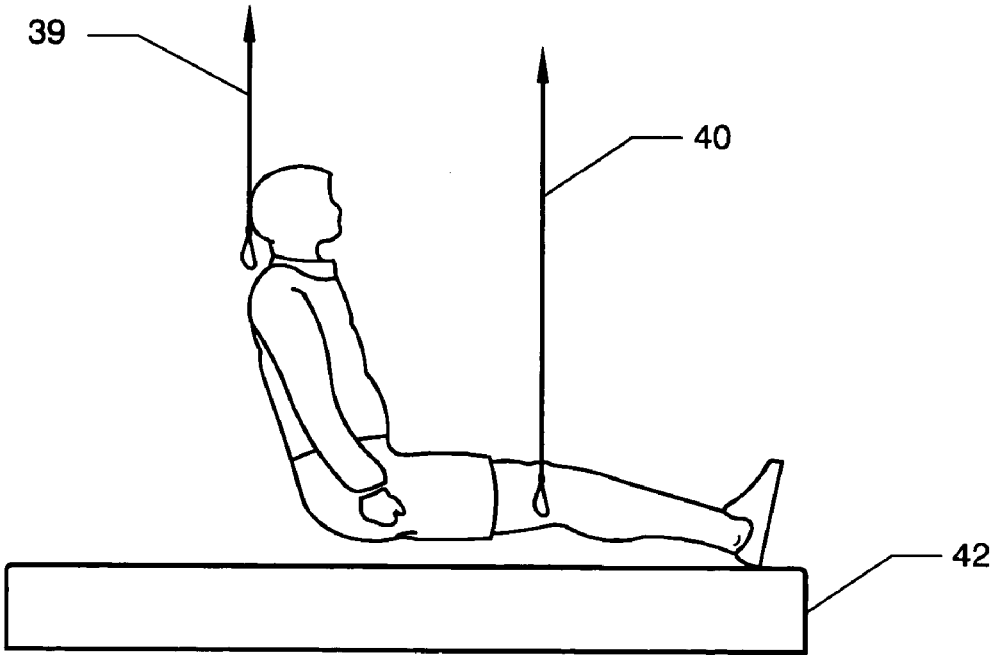
FIG. 3 is an illustration showing that a desired body position may be maintained while lifting the patient with the patient movement apparatus of FIG. 1.

FIG. 3 is an illustration showing lift positions that may be maintained by patient movement apparatus 100. Operation of the patient movement apparatus 100 (not shown in FIG. 3), in this nonlimiting example, allows lower back, hip, and upper legs to be raised above the bed or into other positions. Patient movement apparatus 100 allows the desired body position illustrated in FIG. 2 to be maintained when the patient is lifted, as shown in FIG. 3. As illustrated in both FIGS. 2 and 3, cable slings 39 and 40 are independently adjustable to allow the patient's body to be positioned as desired. It should also be noted that cable slings 39 and 40 are not limited to two in number. Plus, cable slings 39 and 40 may also be used to lift and rotate the patient, such as to turn the patient from his or her front side to his or her back side.

Figure 4:
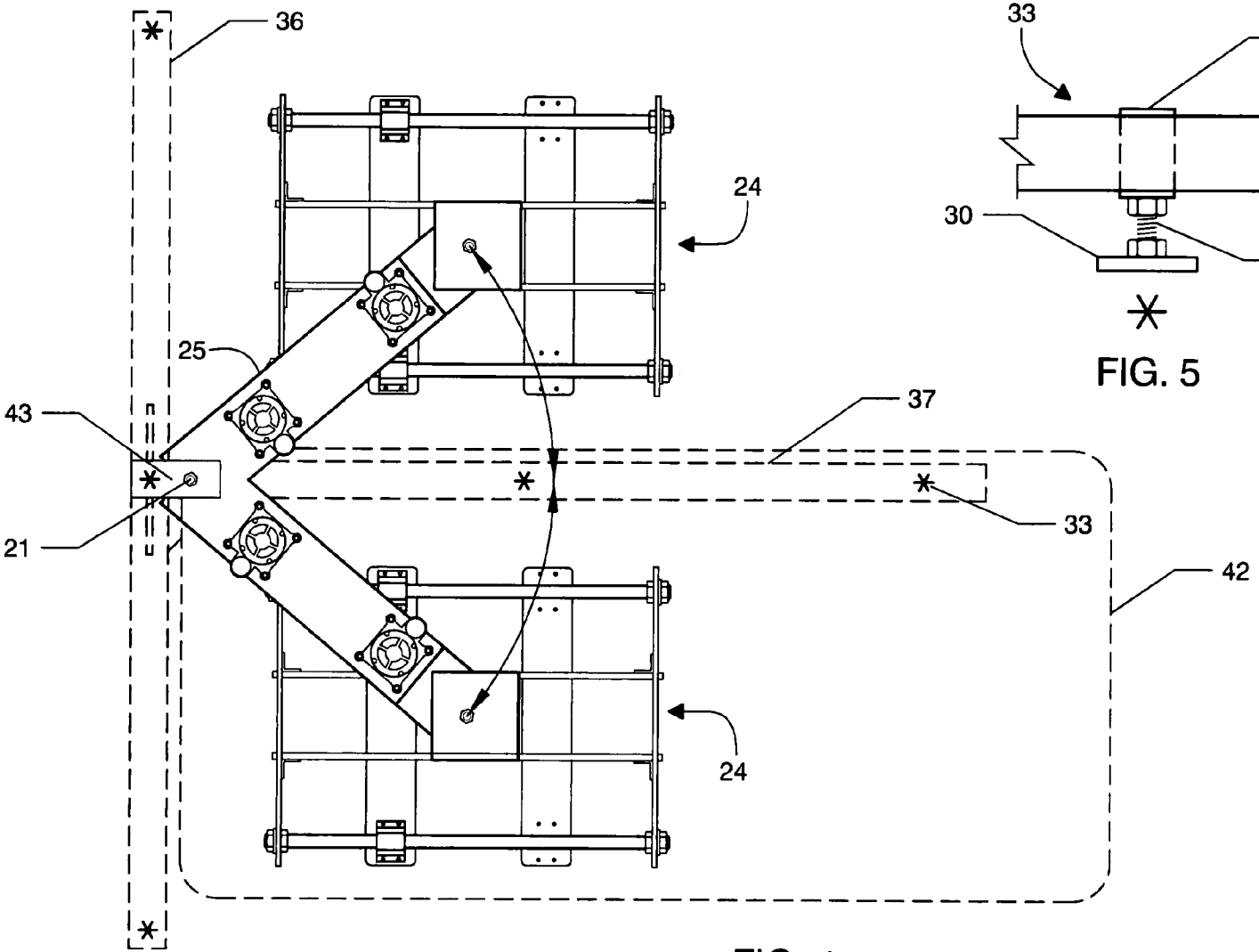
FIG. 4 is an illustration of an overhead view of the patient movement apparatus of FIG. 1.

FIG. 4 is a top-view diagram of patient movement apparatus 100 with hoist assembly 24 and rotating arm assembly 25. This illustration further demonstrates a range of travel for rotating arm assembly 25 from a bed 42 to a floor area (or vice versa) where a whirlpool, wheelchair, or other equipment can be accessed. Either the patient or a caregiver can operate the patient movement apparatus 100 to control this movement operation.

This view also shows base support member 36, which may be configured at varied lengths to provide stability for patient movement apparatus 100. Base support 36 is coupled to base support 37.

In FIG. 4, rotating arm assembly 25 is shown in two positions, as is hoist assembly 24. These positions are only nonlimiting examples to illustrate a range of motion between at least two separate locations-such as between bed 42 and a wheelchair (not shown) that may be positioned alongside bed 42. Rotating arm assembly 25 rotates, in this nonlimiting example, about point 21.

Figure 5:
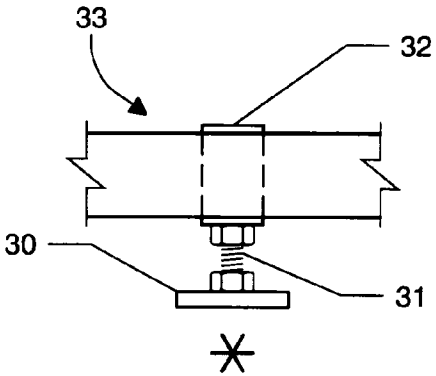
FIG. 5 is an illustration of an adjustable leg unit of the patient movement apparatus of FIG. 1.

FIG. 5 is a diagram of an adjustable leg unit 33, which includes foot plate 30; threaded leg 31; and an insert fastened in a leg section 32, all as nonlimiting examples. Threaded leg 31 may be extended from or into section 32 to adjust the height of leg unit 33. In this nonlimiting example, adjustable leg units 33 are located at the starred locations of FIG. 5.

Figure 6:
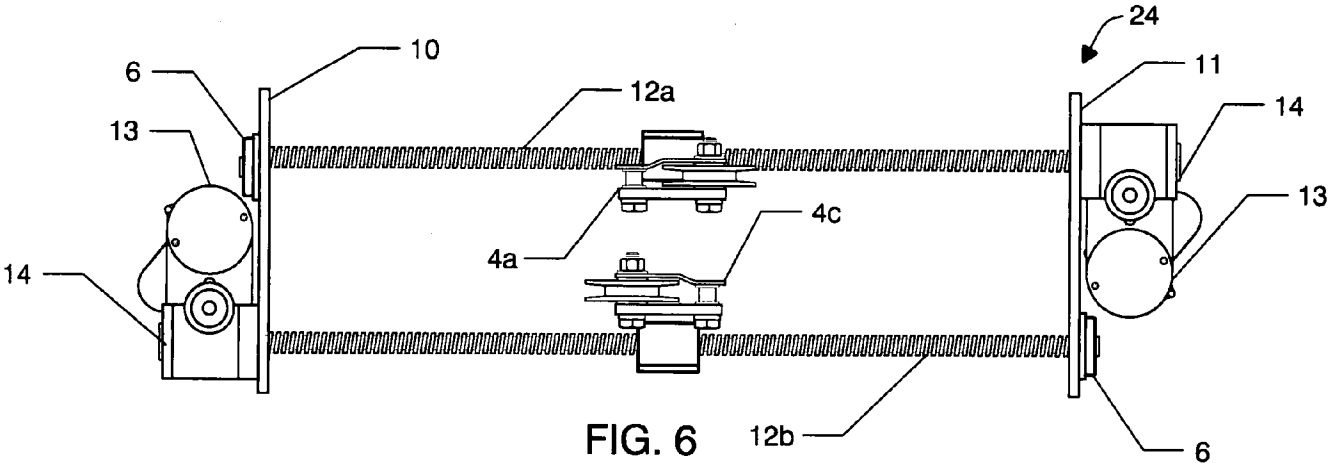
FIG. 6 is a side view of the hoist assembly of the patient movement apparatus of FIG. 1.

FIG. 6 is a partial diagram of hoist assembly 24 (from FIG. 1) showing pulley assemblies 4*a* and 4*c*, travel shaft 12*a* and 12*b*, end cap bearing 6, gear motor 13, gear unit 14, head assembly plate 10, and foot assembly plate 11. As is discussed in more detail below, each motor 13 causes travel shafts 12*a* and 12*b*, which may be screws, to rotate. As they rotate, pulley assemblies 4*a* and 4*b* move linearly toward end plates 10 or 11, depending on the direction of rotation of shafts 12*a* and 12*b*. End cap bearings 6 supports the travel shafts 12*a* and 12*b* while allowing each shaft to rotate.

Figure 7:
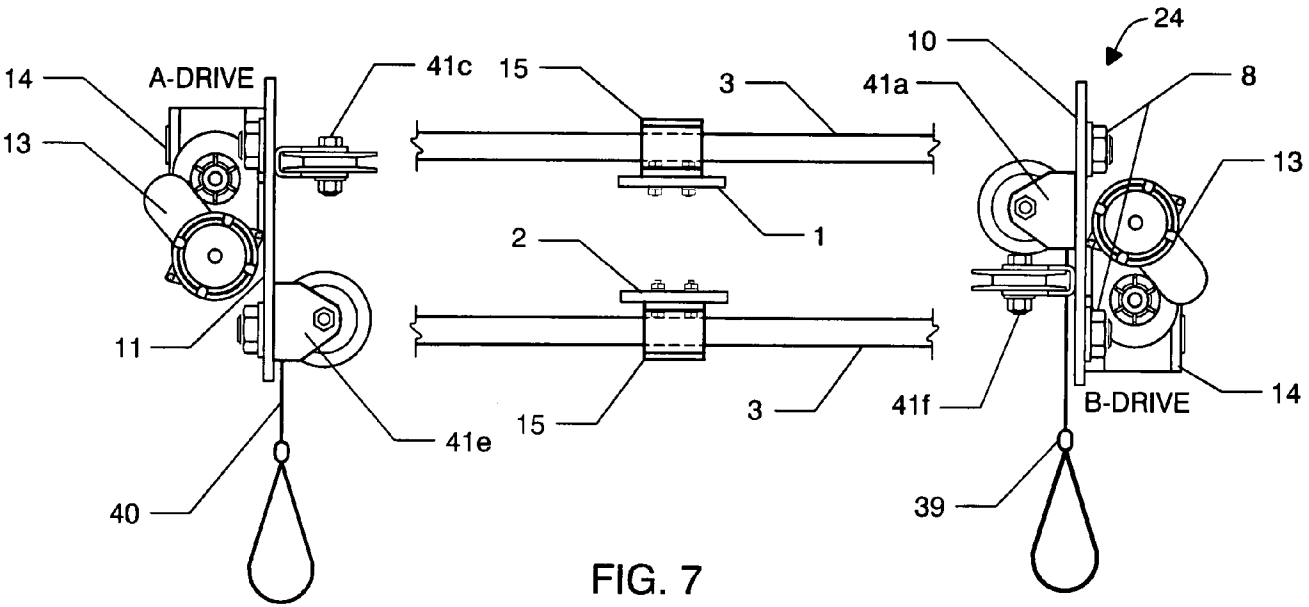
FIG. 7 is an illustration of another side view of the patient movement apparatus of FIG. 1.

FIG. 7 is another partial diagram of hoist assembly 24 depicting guide bars 3 and their assemblies for operation with the head and foot mounting plates 10 and 11 of the pulley assembly. Also included in FIG. 7 are travel guide slide 15, travel plates 1 and 2, securing nut 8, and cable drop 40. One should also note that although FIGS. 6 and 7 are shown as the right and left sides of hoist assembly 24, respectively, these depictions could easily be mirrored such that the device operates in the opposite direction. Further, as is obvious to one with skill in the art, this concept can be applied throughout this disclosure.

Figure 8:
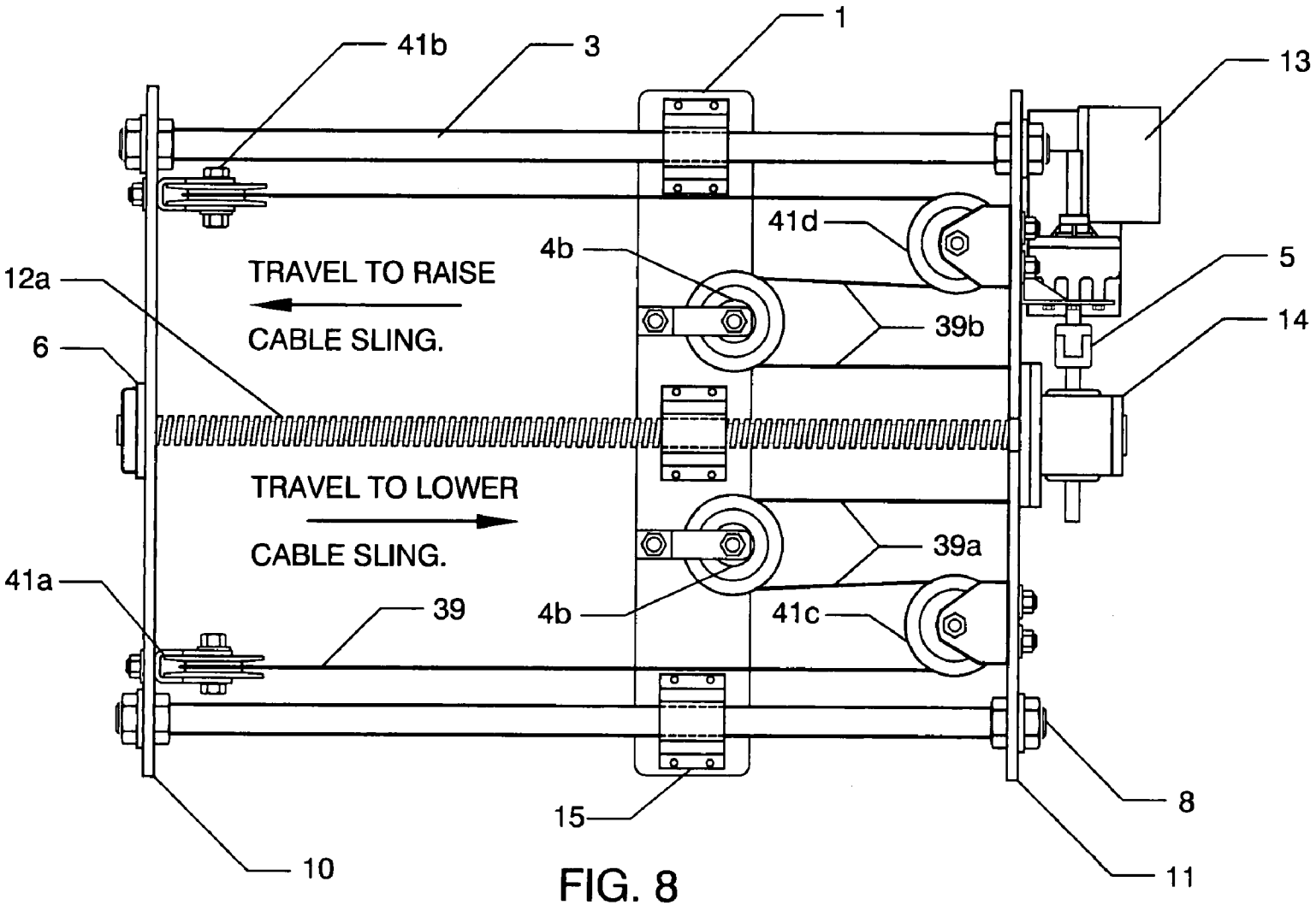
FIG. 8 is an illustration of the A-drive end of the hoist assembly of the patient movement apparatus of FIG. 1.

FIG. 8 provides a top view of a portion of hoist assembly 24 and illustrates movements for raising and lowering a patient. Operation begins when motor 13 turns a travel shaft 5 and moves travel plate 1 linearly from a head assembly plate 10 to a foot assembly plate 11 (or vice versa). More specifically, motor 13 turns shaft 5, which communicates movement to gear unit 14. Gears in unit 14 cause travel shaft 12*a* to rotate. Travel plate 1 is coupled to shaft by, as a nonlimiting example, a screw and nut assembly, which moves plate 1 linearly as travel shaft 12*a* rotates.

The travel plate 1 moves toward the foot assembly plate 11 to lower cable sling 39 at the head assembly plate 10. Similarly, travel plate 1 may also move toward the head assembly plate 10 to raise cable sling 39 at the head assembly plate 10. As travel plate 1 moves, the length of cable 39*a* and 39*b* between pulleys 4*a* and 41*c* as well as pulleys 4*b* and 41*d* is lengthened or shortened, thereby causing a respective raising or lowering action of the patient.

Figure 9:
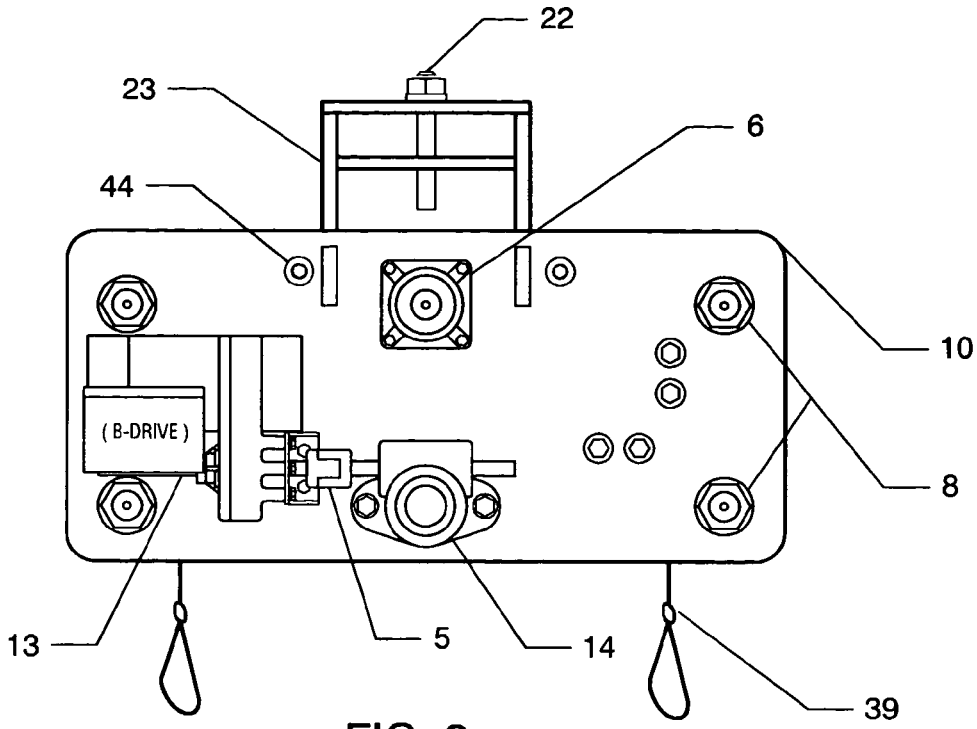
FIG. 9 is an illustration of a head mounting plate of the hoist assembly of FIG. 6.

FIG. 9 is an illustration of head mounting plate 10, including a motor 13. Also shown in this illustration is rotating pin 22, brace 23, face mounting brackets 44, cable sling 39, securing nuts 8 (coupled to guide 3), and end cap bearing 6 (which is for the travel shaft for the A-drive). Like as indicated above, as B-drive motor 13 turns, movement is communicated to gear unit 14, which rotates travel shaft 12. One of ordinary skill would know that various motor assemblies and configurations may substitute for the nonlimiting example shown herein.

Figure 10:
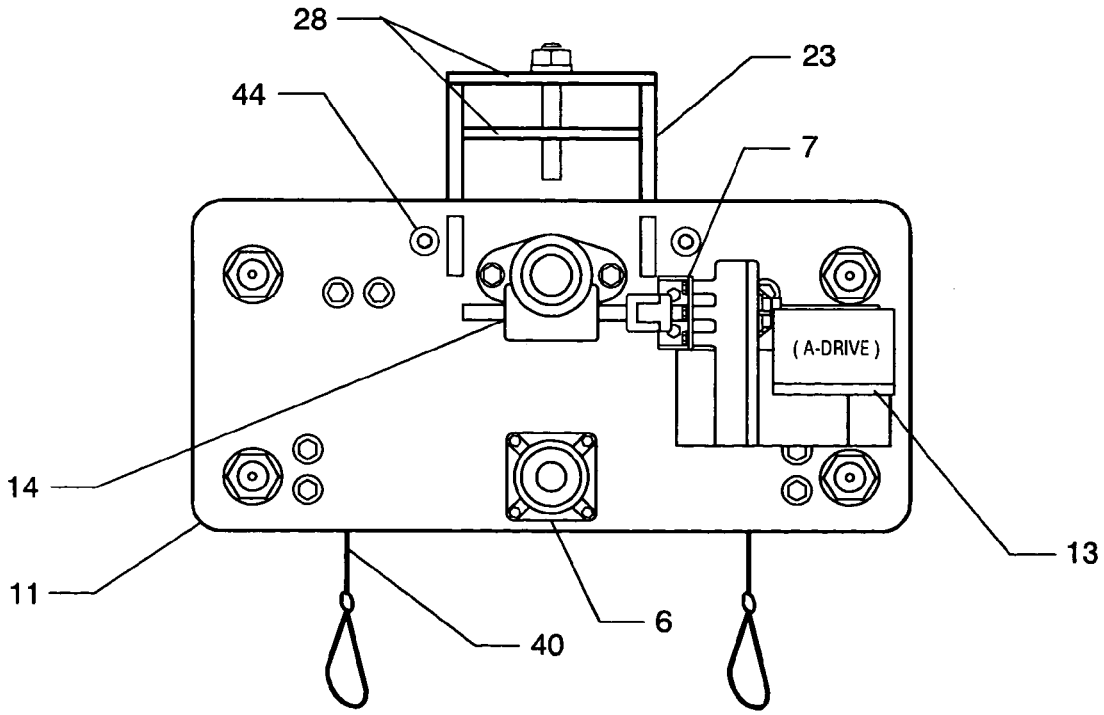
FIG. 10 is an illustration of a foot mounting plate of the hoist assembly of FIG. 6.

FIG. 10 is an illustration of foot mounting plate 11 providing the face of a motor 13 mounted to brace 23. In addition to the elements from previous figures, FIG. 10 also includes cable sling 40, which may be used for lower body lifting. Plus, A-drive motor 13 and gear unit 14 operate like their counterparts of FIG. 9 to rotate shaft 12.

Figure 11:
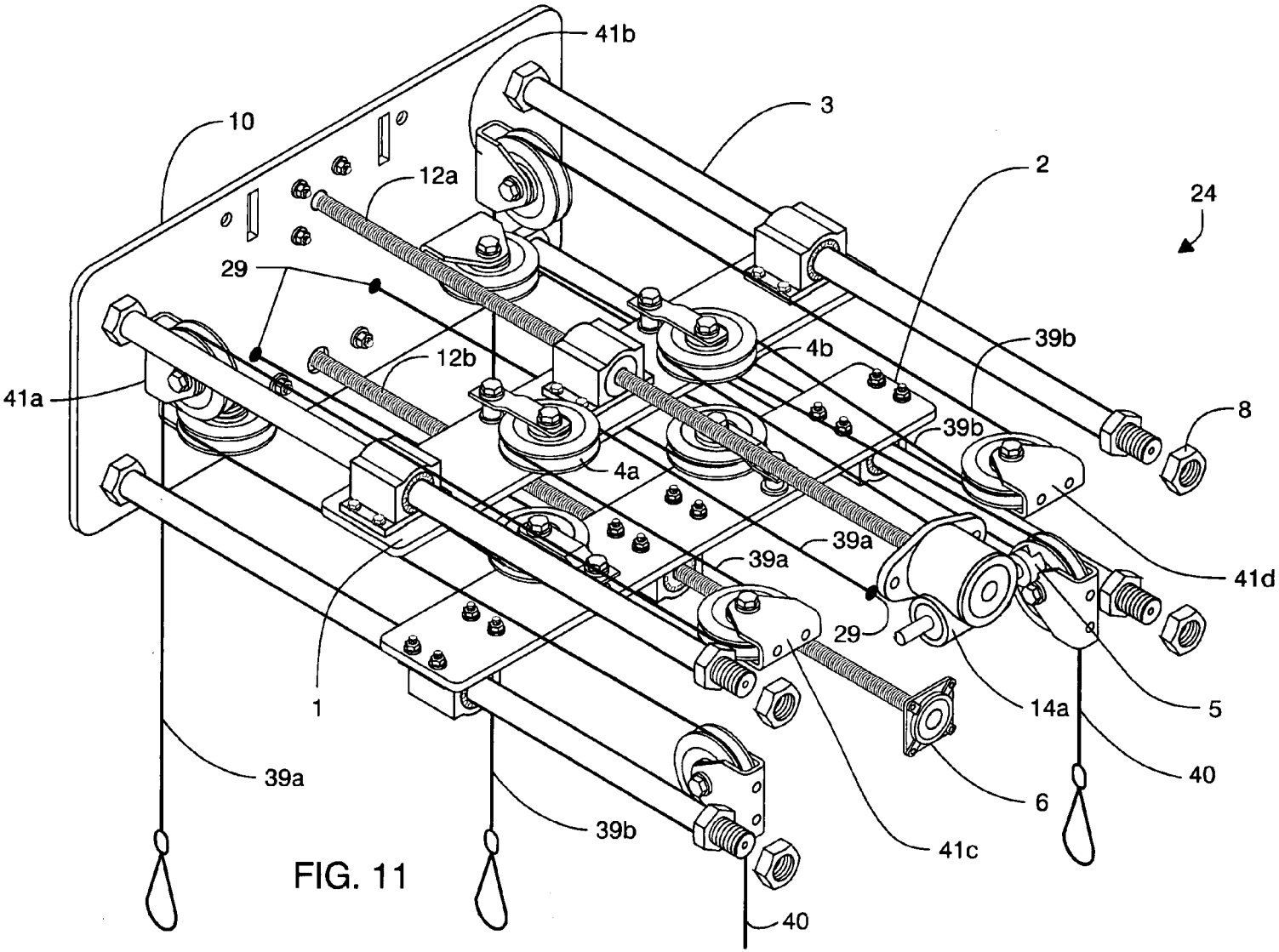
FIG. 11 is an illustration of an iso-exploded view of the hoist assembly of FIG. 6.

FIG. 11 is an illustration of an iso-exploded view of hoist assembly 24 including end-mounting plate 10 (but without plate 11 to better show select components). FIG. 11 also demonstrates cable dead-ends 29. As shafts 12*a* and 12*b* rotate, plates 1 and 2 move accordingly in an orientation between end plates 10 and 11. This movement causes the length of cables 39 and 40 to change, as a portion of each cable's respective length changes horizontally between plates 10 and 11.

As a nonlimiting example, when motor 13 moves gear reduction unit 14*a*, shaft 12*a* moves plate 1 toward end plate 10. At the same time, the cables 39*a* and 39*b* between pulleys 4*a*/4*b* and 41*c*/41*d*, respectively, lengthen. This lengthening causes the ends of cables 39*a* and 39*b* to move upward toward pulleys 41*a* and 41*b*, respectively. Of course, rotating motor 13 in the opposite direction causes the opposite result, which is that cables 39*a* and 39*b* move down away from pulleys 41*a* and 41*b*, respectively. (This action works as well in regard to the B-drive motor coupled to end plate 10.)

Figure 12:
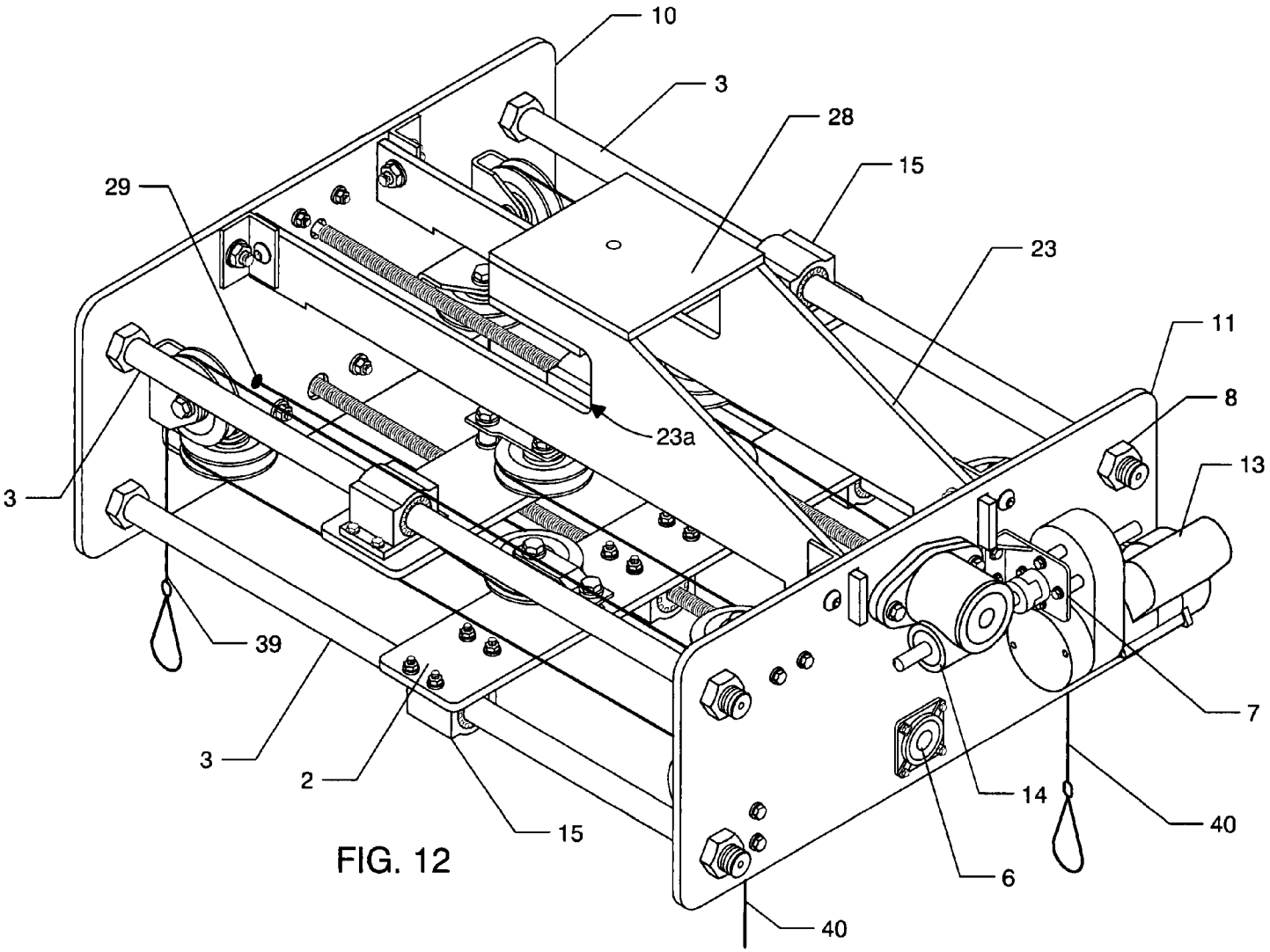
FIG. 12 is an iso-view illustration of a portion of the hoist assembly of FIG. 6.

FIG. 12 is similar to FIG. 11, with the addition of brace 23, mounting plate 28, linear bearing runner 15, foot assembly plate 11, motor 13, and mounting bracket 7. Brace 23 couples to arm assembly 25 of FIG. 4. Brace 23 includes an open section 23*a*, wherein it is coupled to rotating arm assembly 25. This open section 23*a* enables the entire hoist assembly to rotate about rotating arm assembly 25. If desired, a light may be positioned in the bottom surface of slide plate 2, which may be operable by the person being lifted to aid in operating the present invention and/or merely for reading, etc.

Figure 13:
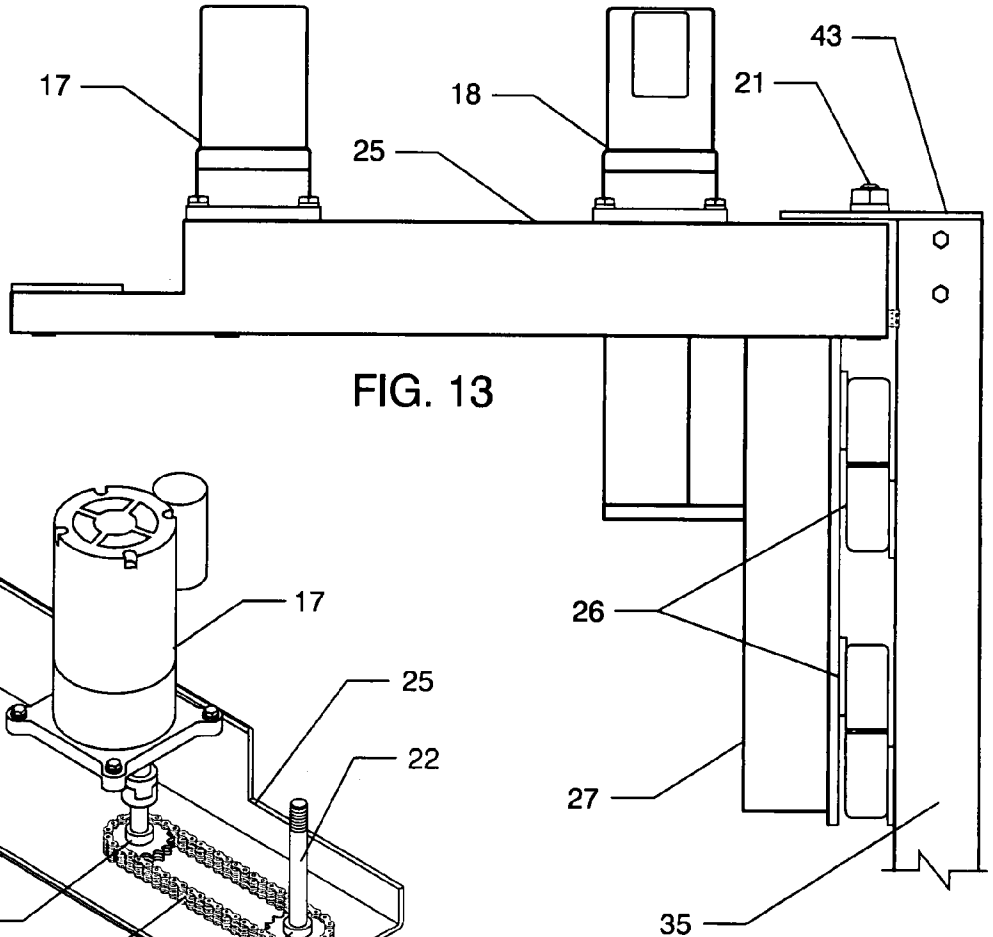
FIG. 13 is an illustration of the rotating arm assembly of the patient movement apparatus of FIG. 1.

FIG. 13 is a diagram of an arm assembly 25 including barrel hinges 26 (as a nonlimiting example) fastened to a back member 27 and vertical member 35. Also illustrated in FIG. 13 is gear motor 17 (which rotates hoist assembly 24), gear motor 18 (which rotates the rotating arm assembly 25), fixed swivel rotating pin 21, and rotating arm top swivel plate 43. Plate 43 is coupled to the end of member 35 but is not in contact with arm 25. Instead, pin 21 is coupled to plate 43 and to rotating arm assembly 25, as described below, to provide a basis point of rotation for rotating arm assembly 25.

Figure 14:
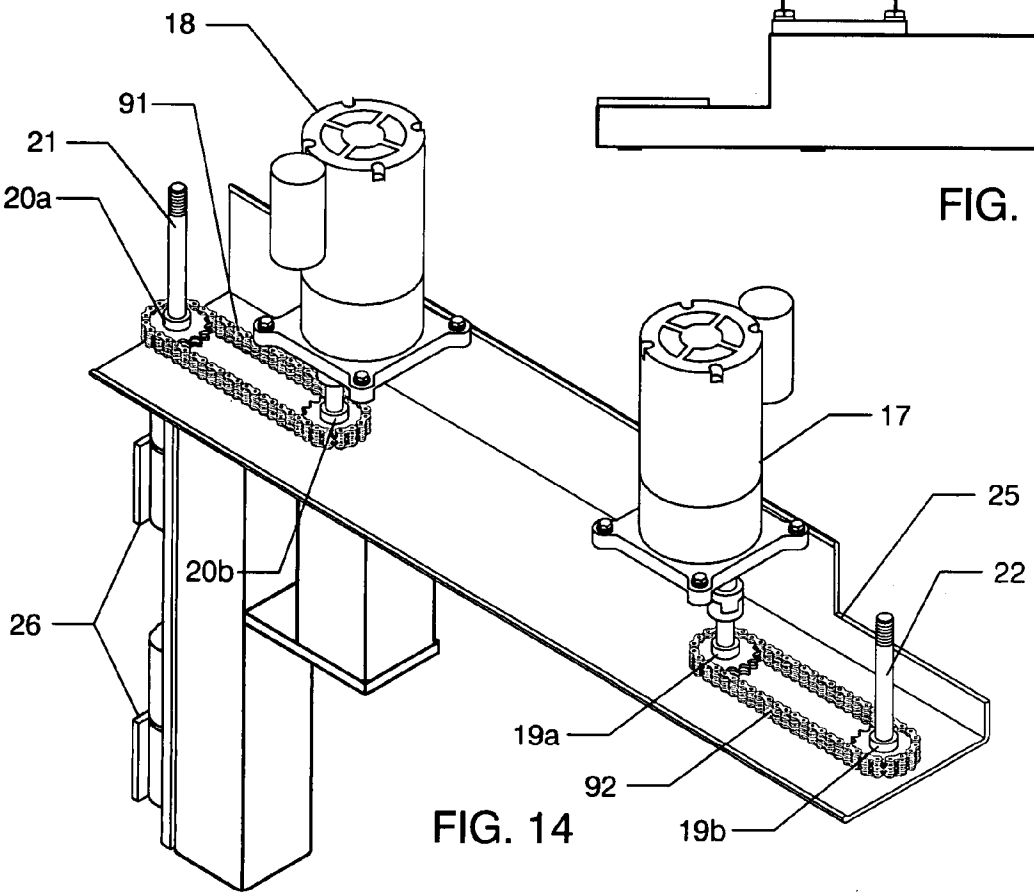
FIG. 14 is a perspective view showing a portion of the rotating arm assembly of FIG. 13 and the patient movement apparatus of FIG. 1.

FIG. 14 is a perspective view of the rotating arm assembly of FIG. 13, also including gear motors 17 and 18 in relation to the drive assemblies and barrel hinges 26. Additionally included in FIG. 14 are, as nonlimiting examples, double roller drive sprockets 19 and 20. Double roller drive sprockets 19*a* and 19*b* rotate brace 23 and hoist assembly 24, and double roller drive sprockets 20*a* and 20*b* rotate the entire rotating arm assembly 25. One of ordinary skill would know that other types of devices could be used in place of motors 17 and 18. As a nonlimiting example, a worm gear motor could be used instead such that the motor turns a screw that stays in mechanical communication with double roller drive sprockets 19 and 20.

As motor 18 turns sprocket 20*b*, chain 91 turns sprocket 20 around a stationary pin 21 and barrel hinges 26. Thus, this action causes rotating arm assembly 25 to rotate about pin 21. Similarly, as motor 17 rotates sprocket 19*a*, chain 92 turns sprocket 19*b*, which turns pin 22. As pin 22 turns, this causes hoist assembly 24 to rotate.

Figure 15:
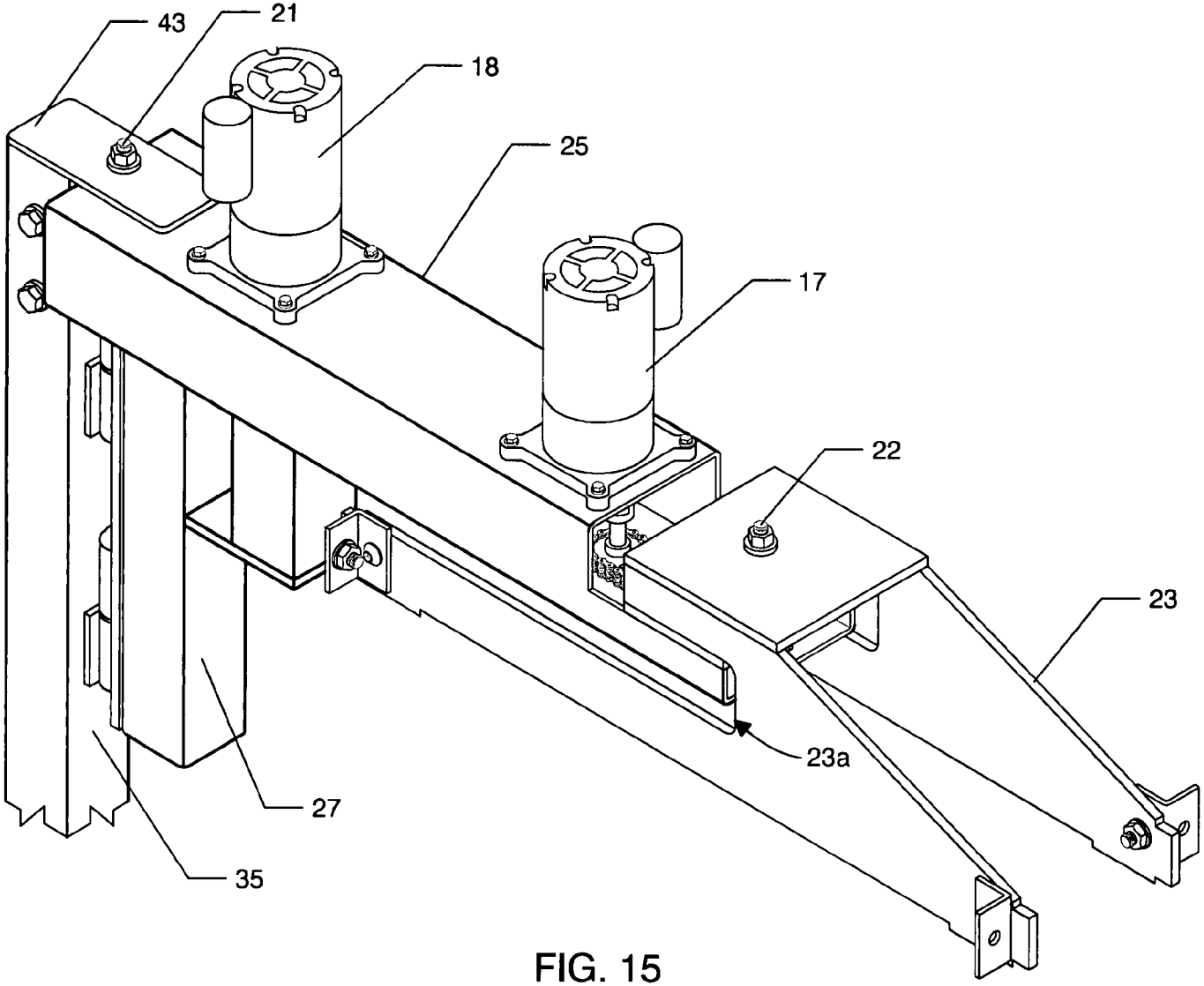
FIG. 15 is a perspective view of the rotating arm assembly of the patient movement apparatus of FIG. 1.

FIG. 15 is a diagram of a rotating arm assembly 25 coupled to brace 23, which couples to hoist assembly 24 (not shown). As shown in FIG. 15, brace 23 rotates about pin 22, as controlled by motor 17. In this nonlimiting example, cutout shape 23*a* establishes the range of motion of brace 23.

Figure 16:
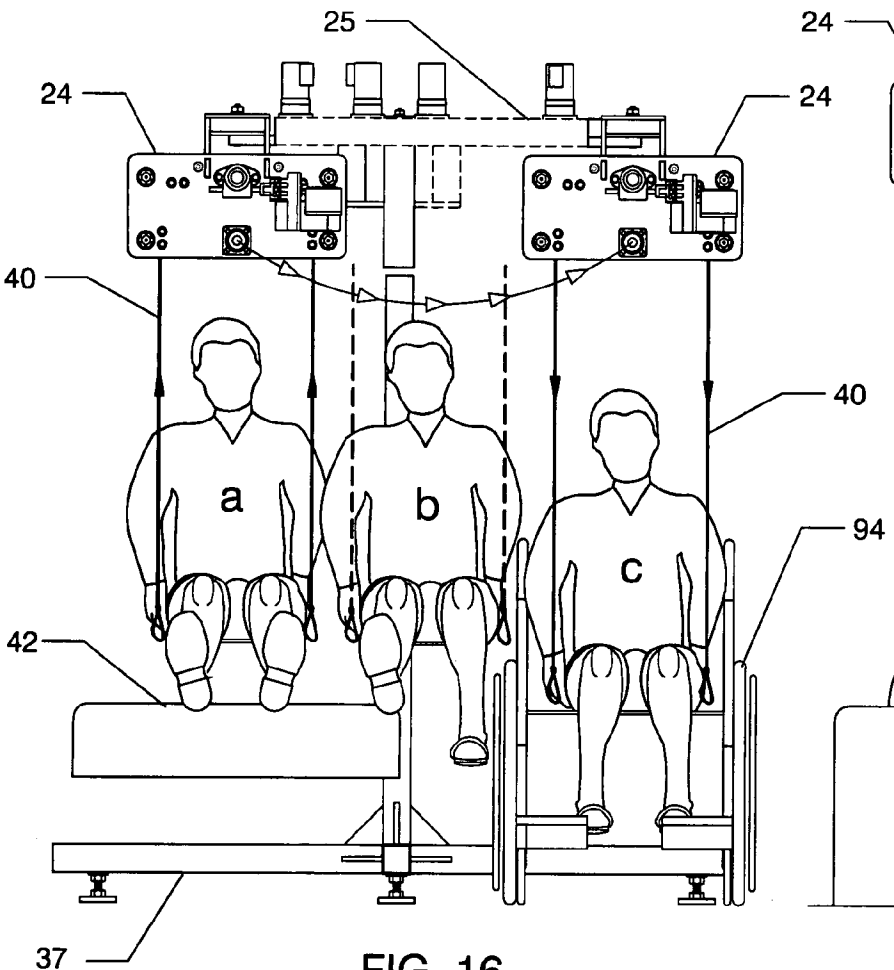
FIG. 16 is an illustration depicting relative body positions as the patient movement apparatus of FIG. 1 operates to place the patient from a wheelchair to a bed.

As a nonlimiting example, FIG. 16 depicts a person being lifted from a bed 42 to a wheelchair 94 by patient movement apparatus 100. The motion is depicted by persons "a," "b," and "c," which represent different positions. In this nonlimiting example, hoist assembly 24 may lift the person from the bed into position "a." Thereafter, rotating arm assembly 25 may be rotated to move the person to position "b," and then to position "c," as described above. Thereafter, hoist assembly 24 may be controlled, as described above, by the person to lower the person into wheelchair 94, according to cables 39 (not shown) and 40.

Figure 17:
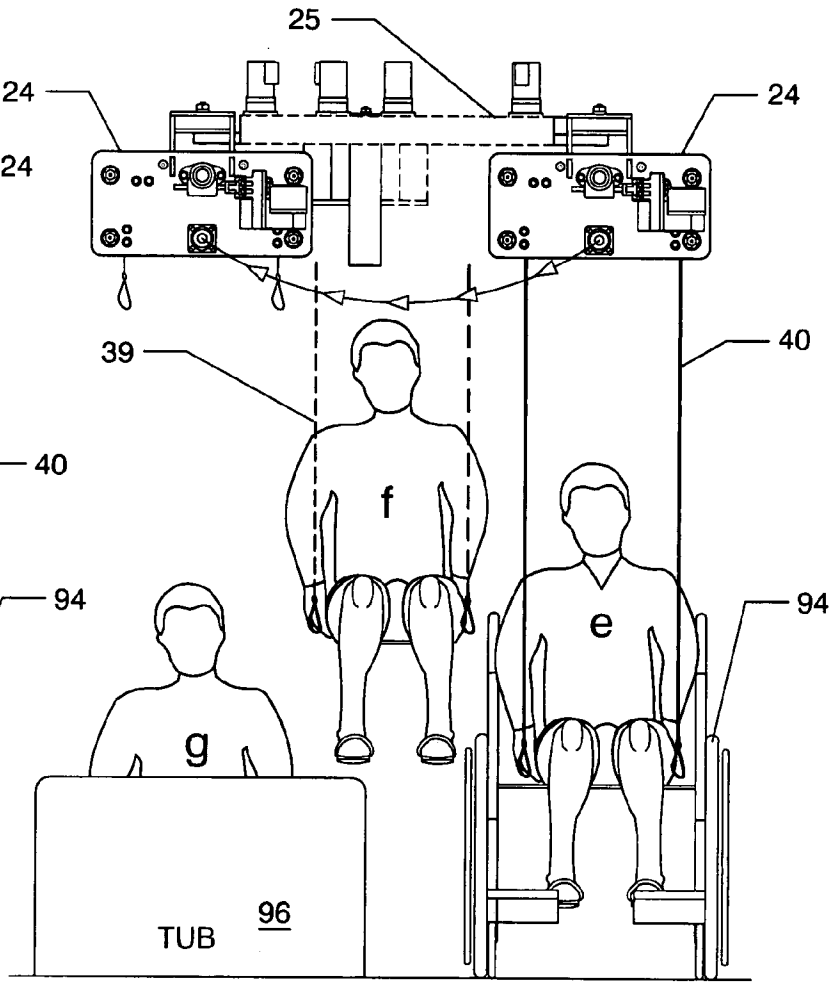
FIG. 17 is an illustration depicting relative body positions as the patient movement apparatus of FIG. 1 operates to place the patient from a wheelchair to a bathtub.

Further, as illustrated in FIG. 17, patient movement apparatus 100 can be applied to move the patient/person from a wheelchair 94 to a bathtub 96. In this nonlimiting example, the patient movement apparatus 100 may be coupled to a wall and thereby omit base and floor units 35, 36, and 37, as described above. Hoist assembly 24 may be controlled by the patient to lift herself from wheelchair 94 in position "e." Thereafter, rotating arm assembly 25 may be rotated by motor 18, as described above to position "f." Then, hoist assembly 24 may be controlled to lower the person to tub 96 into position "g." As patient movement apparatus 100 may be coupled to a wall in this nonlimiting example, a person may have several devices 100 in a home so as to access chairs, tubs, tables, beds, etc.

Figure 18:
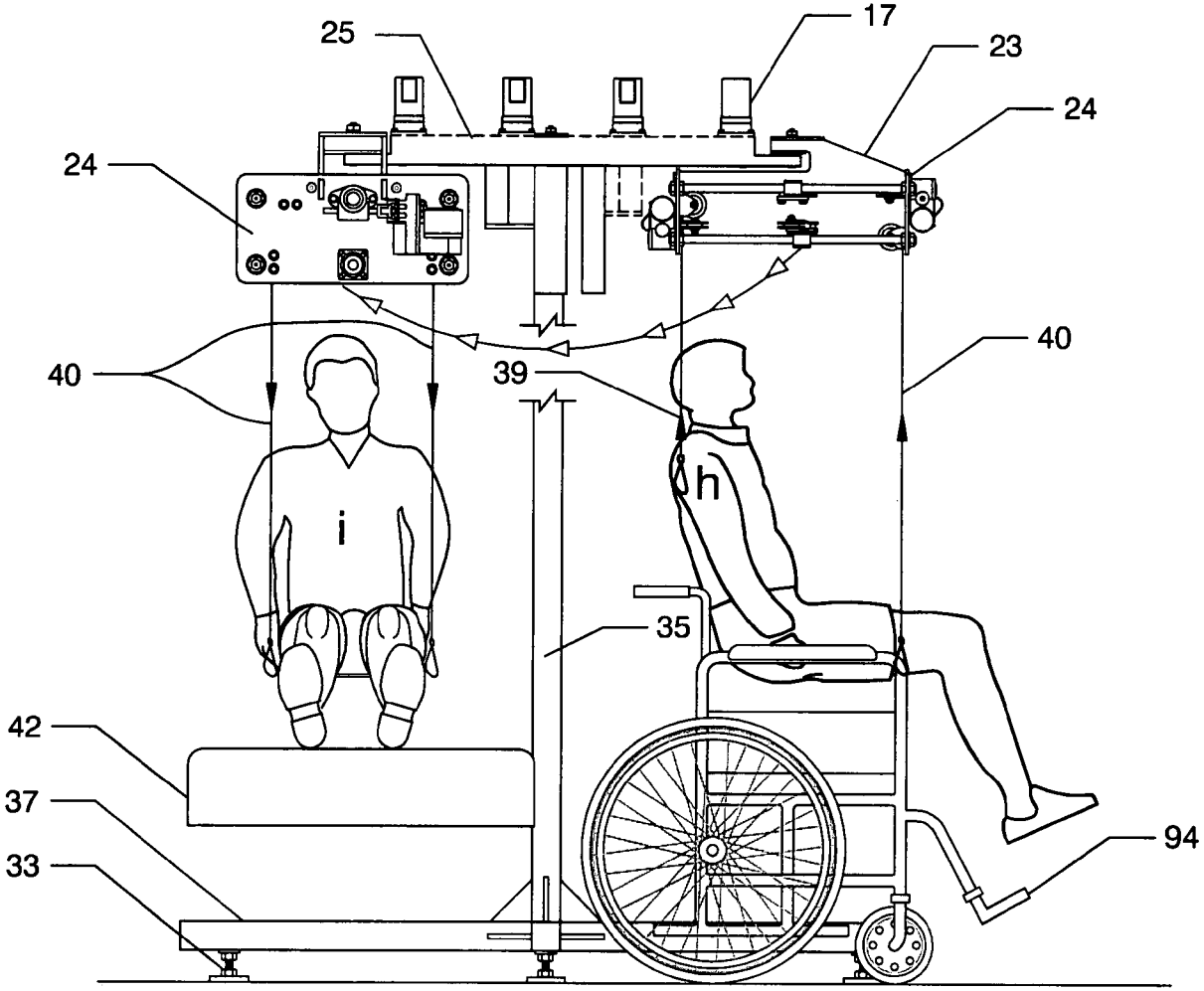
FIG. 18 is an illustration depicting operation of the patient movement apparatus of FIG. 1 when the patient's initial orientation is not the same as the desired orientation.

FIG. 18 is an illustration of hoist assembly 24 lifting a person in a wheelchair 94 labeled position "h" to bed 42, labeled position "i." Here, the wheelchair 94 is not parallel to the bed 42. In other words, the person's original orientation is not the same as the desired orientation. As discussed above, hoist assembly 24 may be rotated to angles that are not parallel to the initial position of rest. More specifically, motor 17 may rotate brace 23, which is coupled to rotating arm assembly 24. Thus, one of ordinary skill in the art would know that the hoist assembly 24 is configurable at a multitude of receiving and depositing angles.

Instead of brace 23 being affixed to rotating arm assembly 25, an alternate embodiment of the present disclosure provides for coupling the hoist assembly 24 to a track or trolley system (not shown), whereby the patient can travel along a path defined by the track or trolley. As a nonlimiting example, the patient using this device could have mobility within the person's home so equipped with the track or trolley system. A track or trolley system could be configured so that the device can hoist a patient from the bed in the bedroom and travel along a track to the bathtub, where the patient may be lowered. The track or trolley could enable the user to utilize other region of a home or other area so as to provide freedom of movement within that environment.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiments of the present disclosure without departing substantially from the spirit and principles of the invention. All such modifications and variations are intended to be included herein within the scope of this disclosure and the present and protected by the following claims.

The invention claimed is:

1. A human movement system, comprising:

a supporting frame;

a rotatable section coupled to the frame and configured to move in a horizontal plane in a predetermined range of motion;

a hoist assembly coupled to the rotatable section and configured to rotate respective to the rotatable section within a predetermined range of motion, wherein the hoist assembly further comprises:

a first motor coupled to a first linearly moving pulley by a first linkage, wherein the first linkage includes horizontal and vertical sections of travel, and wherein the vertical sections of travel are shortened when the horizontal sections of travel are lengthened;

a second motor coupled to a second linearly moving pulley by a second linkage; wherein the second linkage includes horizontal and vertical sections of travel, and wherein the vertical sections of travel are shortened when the horizontal sections of travel are lengthened.

2. The system of claim 1, wherein the first motor is coupled by the first linkage to one or more stationary pulleys in addition to the first linearly moving pulley.

3. The system of claim 1, wherein the second motor is coupled by the second linkage to one or more stationary pulleys in addition to the first linearly moving pulley.

4. The system of claim 1, wherein the first linearly moving pulley travels in an orientation that is parallel to the travel of the second linearly moving pulley.

5. The system of claim 1, further comprising:

a first motor coupled to the rotatable section that communicates movement to the frame so that the rotatable section swings about an axis point of connection to the frame.

6. The system of claim 1, further comprising:

a second motor coupled to the rotatable section that communicates movement to the hoist assembly so as to turn the hoist assembly to selected position within the predetermined range of motion of the hoist assembly.

7. The system of claim 1, further comprising:

a first harness coupled to a termination point of the first linkage, wherein the harness may be fitted to a person to be moved; and a second harness coupled to a termination point of the second linkage, wherein the harness may be fitted to a person to be moved.

8. The system of claim 1, wherein the movements of the first and second linkages may be controlled independently of each other so as to achieve a plurality of lifting orientations.

9. The system of claim 1, wherein the frame includes a vertical section and a base section to support the hoist assembly.

10. The system of claim 1, wherein the frame includes a vertical section that is secured to a wall.

11. A hoist assembly for controlling the lifting and lowering of a person, comprising:

first and second end plates separated by a plurality of guides extending between the first and second end plates;

a first moving device coupled to the first end plate and to a first screw that extends between the first and second end plates;

a first traveler coupled to the screw and one or more of the guides and having one or more pulleys coupled to linkages extending from the first moving device to the person a second moving device coupled to the second end plate and to a second screw that extends between the first and second end plates; and a second traveler coupled to the screw and one or more of the guides and having one or more pulleys coupled to linkages extending from the second moving device to the person.

12. The hoist assembly of claim 11, further comprising a plurality of pulleys attached to the first and second end plates, wherein a first group of pulleys are coupled to the first linkage and a second group of pulleys are coupled to the second linkage.

13. The hoist assembly of claim 11, wherein the length of a horizontal section of each of the first and second linkages is changed by the first and second moving devices so as to adjust the length of a vertical section of each of the first and second linkages.

14. The hoist assembly of claim 13, wherein the length of the vertical section of each of the first and second linkages decreases when the length of the horizontal second of the first and second linkages increases.

15. The method of claim 11, wherein each of the first and second linkages includes a harness that supports the person lifted and lowered.

16. A method for moving a person from a first position to a second position, comprising the steps of:

positioning a hoist assembly having a first and second motor each coupled to linkages that route horizontally and vertically and couple to the person;

operating a first motor to move a first linkage horizontally around a plurality of pulleys to a pulley that adjusts the first linkage to a vertical orientation extending to the person;

operating a second motor to move a second linkage horizontally around a plurality of pulleys to a pulley that adjusts the second linkage to a vertical orientation extending to the person; and wherein the length of the horizontal sections of each of first and second linkages increases as the person is lifted, and wherein the length of the horizontal sections of each of first and second linkages decreases as the person is lowered.

17. The method of claim 16, wherein each of the first and second linkages include a harness that supports the person lifted and lowered.

* * * * *